US007590256B2

(12) United States Patent
Dittli

(10) Patent No.: US 7,590,256 B2
(45) Date of Patent: Sep. 15, 2009

(54) ANGLE PIECE AT HEARING DEVICES

(75) Inventor: Erich Dittli, Reichenburg (CH)

(73) Assignee: Phonak AG, Stafa (CH)

( * ) Notice: Subject to any disclaimer, the term of this patent is extended or adjusted under 35 U.S.C. 154(b) by 592 days.

(21) Appl. No.: 10/953,678

(22) Filed: Sep. 29, 2004

(65) Prior Publication Data

US 2006/0072775 A1 Apr. 6, 2006

(51) Int. Cl.
*H04R 25/00* (2006.01)

(52) U.S. Cl. ..... 381/330; 381/322

(58) Field of Classification Search ..... 381/322–324, 381/327–331, 380–383; 181/128–130
See application file for complete search history.

(56) References Cited

U.S. PATENT DOCUMENTS 4,677,675 A * 6/1987 Killion et al. ..... 381/322
7,020,298 B1 * 3/2006 Tziviskos et al. ..... 381/330
7,123,733 B1 * 10/2006 Borowsky et al. ..... 381/322
2005/0147269 A1 * 7/2005 Oliveira et al. ..... 381/382

FOREIGN PATENT DOCUMENTS

| | | | |
|---|---|---|---|
| DE | 2721469 | A1 | 11/1978 |
| EP | 1338841 | A2 | 8/2003 |
| EP | 1443802 | A2 | 8/2004 |

* cited by examiner

*Primary Examiner*—Suhan Ni
(74) *Attorney, Agent, or Firm*—Pearne & Gordon LLP

(57) ABSTRACT

At the exit of a hearing device (3) (for producing acoustic or sound-signals) a tube-like connecting-element or an angle piece (21) is arranged. At the end of the connecting element or angle piece (21) a thread (23) is arranged for connecting a tube (29) for sound or acoustic transmission of the signal of the hearing device into an ear-cannel.

15 Claims, 2 Drawing Sheets

ANGLE PIECE AT HEARING DEVICES

BACKGROUND OF THE INVENTION

The present invention refers to a hearing device in particular designed for being worn at the pinna or behind the ear respectively according to the wording of claim 1.

At the pinna or behind the ear worn hearing devices usually comprise at the exit for the acoustic signal so-called hearing angle means or an arcuated acoustic transmission element, respectively, on which an acoustic connection-tube is attached for the transmission of the signal or sound respectively into the auditory cannel. In existing hearing devices which comprise the mentioned hearing angle piece, also so-called hear-hook for the connection of the tube at the ear-adapter for sealing and the retention of the tube normally a flange is arranged at the ear-hook. To guarantee a firm connection of the tube at the ear-hook this flange usually is sharp-edged finished.

In particular for so-called power-hearing devices usually thicker transmission tubes are used, which can only be attached onto the hook by having widened first the end for attachment. This usually requires a specific gripper instrument. Furthermore, in case of removing this tube or also thinner standard tubes from the hook usually an additional problem occurs. The tube hardens usually and adapts to the flange or the sharp-edged angle respectively, and can only be removed from the hook by applying a great effort or by being destroyed respectively. Due to this reason very often the acoustic transmission tube as well as also very often the hook has to be changed completely. It is therefore an object of the present invention to propose a solution for the above mentioned problem.

BRIEF SUMMARY OF THE INVENTION

Therefore, according the present invention proposed is a hearing device, in particular designed for being worn at the pinna or behind the ear comprising an angle piece or a hear-angle piece according to the wording of claim 1. According the present invention it is proposed, that at one end of the angle piece instead of a flange a thread is arranged which is suitable for the connection or the releasable firm attachment of the acoustic transmission tube at the angle piece or the hearing device respectively. By arranging a terminal thread the acoustic transmission tube can either be arranged by screwing at the angle piece as well as of course also by slipping onto the end-section, as it is done at conventional flanges of angle pieces. The advantage is that the removal of the tube is much easier as it is at conventional arranged flanges.

According a further aspect of the angle piece it is possible in addition-to the thread to arrange a cylindrical sealing surface to enhance the reliability of the sealing at the connection of the angle piece to the acoustic transmission tube.

Again, according a further aspect of the present invention it can be an advantage that the toward outside protruding outlines of the windings are not rounded but at least designed as an angle to guarantee a good retention of the tube at the connection to the angle piece.

BRIEF DESCRIPTION OF THE SEVERAL VIEWS OF THE DRAWINGS

Further preferred designs are characterised in dependent claims. The invention shall be further explained by examples and with reference to the attached figures. In that respect

DETAILED DESCRIPTION OF THE INVENTION

Figure 1:
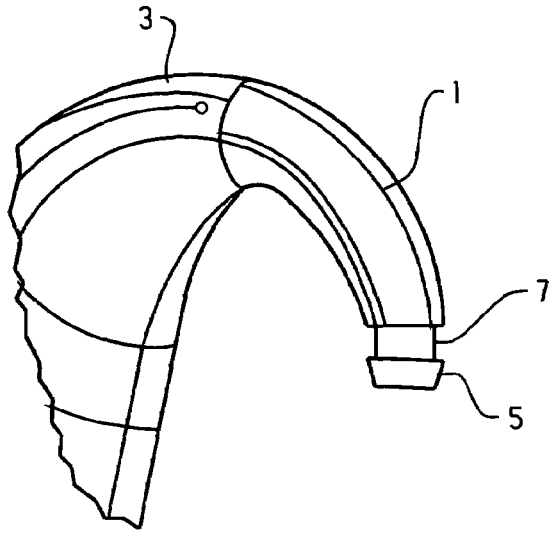
FIG. 1 shows a schematic view of an angle piece arranged at the hearing device comprising a conventional flange.

FIG. 1 shows an angle piece 1 also so-called ear-hook for connecting an acoustic transmission tube to a hearing device 3. The conventional angle piece as known comprises at one end a flange 5 as well as a cylindrical sealing surface 7.

Figure 2:
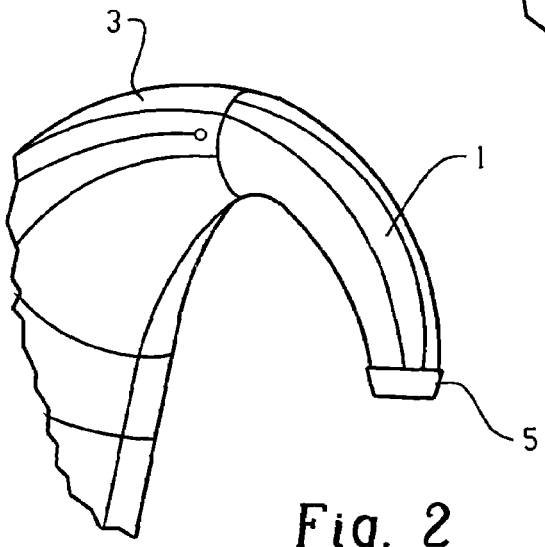
FIG. 2 shows a further conventional angle piece arranged at the hearing device.

FIG. 2 shows in the same manner a conventional angle piece 1 as known at which however at the end only a flange 5 is provided without the sealing surface 7, as shown in FIG. 1.

Figure 3:
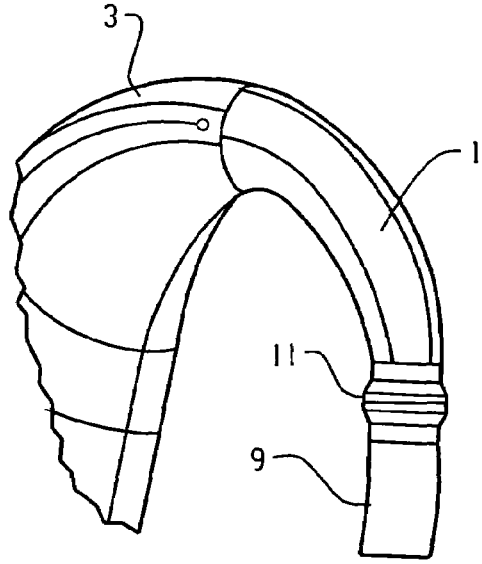
FIG. 3 shows in schematic view an acoustic transmission tube attached to a conventional angle piece.

FIG. 3 shows an acoustic transmission tube 9 attached to the terminal flange at which in the area of the flange of the angle piece 1 a bulb is shaped. Due to the sharp-edged design of the flange 5 as shown in the FIGS. 1 and 2 removing the tube 9 practically is not possible anymore without damaging or even destroying the latter.

Figure 4:
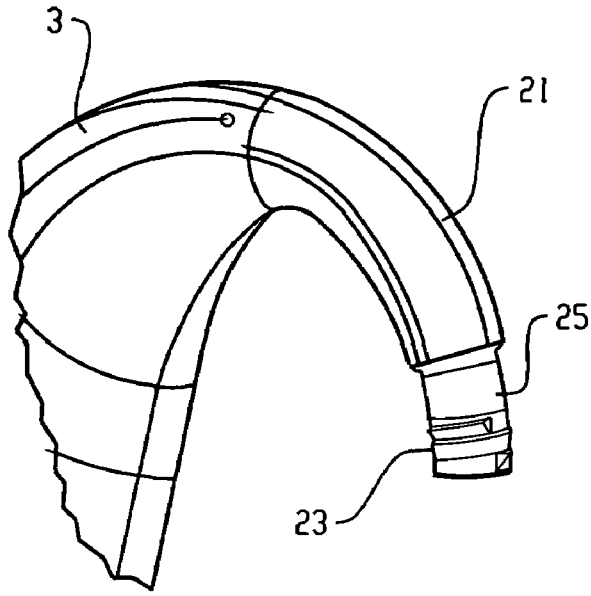
FIG. 4 shows an inventive angle piece at a hearing device comprising a terminal thread.

Correspondingly and according the present invention it is proposed as shown in FIG. 4 schematically to provide a thread 23 at the angle piece or ear-hook 21 to which the acoustic transmission tube can be attached. Optionally it is possible to further provide a sealing surface 25 to create eventually an even better acoustic sealing at the area of the connection.

FIG. 5 again shows schematically an acoustic transmission tube 29 at the angle piece 21 which either can be thread on to the winding 23 or can be slipped on to the thread in a conventional manner. The great advantage of arranging a thread is that on one side the shaping of a bulb, as shown with reference to FIG. 3 does not occur and in addition removing the acoustic transmission tube 29 is essential easier, as this may be executed by easily screwing-off without the need of damaging or even destroying the tube. The same of course is valid also for the angle piece 21, which has not to be damaged or destroyed for removing the tube.

The connection of the angle piece 21 itself to the hearing device 3 can be done in a conventional manner and therefore is not an object of the present invention. In other words the angle piece 21 can be slipped onto a projection or can be screwed onto a winding at the hearing device 3.

Figure 6:
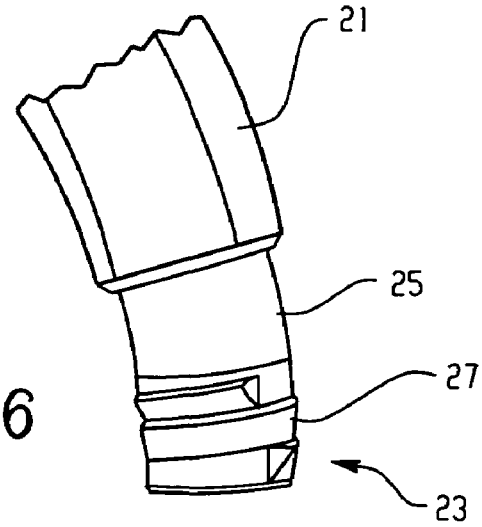

FIG. 6 finally shows in a sectional view the terminal thread 23 at the angle piece 21. According one aspect it is possible to design the individual windings 27 angle-like or as sharp edges to effectively prevent the tube being removed after attachment. Again, as shown in FIG. 6 it is possible to provide a sealing surface 25 between the thread and the wall of the angle piece 21.

Figure 5:
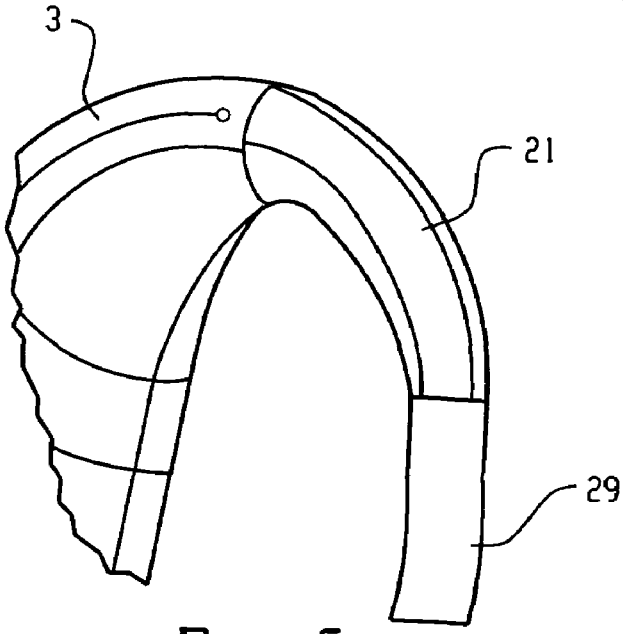
FIG. 5 shows schematically an acoustic transmission tube attached to the inventive angle piece and FIG. 6 shows in enlargement a section of the terminal area of the hear-angle piece comprising the inventively proposed connecting thread.

The angle piece and ear-hook as shown with reference to FIGS. 4 to 6 is of course only a possible design example and the present invention is by no means limited to the views in the mentioned figures. In particular it is possible to design the terminal thread in any possible manner whereby preferably it should be taken into consideration, that by the chosen angle-form a simple removing of the attached acoustic transmission tube can be prevented. The materials used for the hearing-angle or angle piece respectively are no topic of the present invention and all materials as known in the state of the art are usually suitable for the production of the inventive hearing-angle or angle piece respectively.

The invention claimed is:

1. Hearing-device for being worn at the pinna or behind the ear, respectively, comprising an exit for sound-signals, characterized in, that at the exit an angle piece is arranged for connecting the exit with a threadless tube for the sound transmission to an ear canal;

wherein the angle piece has a thread at one end for an attachment of the threadless tube to the angle piece;

wherein an outline of the thread has an edge and the thread is configured for engaging and retaining the threadless tube by either a force-fit slipping of the threadless tube over the edge of the thread or by a screwing the threadless tube over the thread.

2. Hearing device according claim 1 characterized in that between the thread and a wall of the angle piece respectively a sealing-surface is arranged.

3. Hearing-device according to claim 1 wherein the angle piece is configured for connecting with thicker acoustic transmission-tubes when the hearing device is a power-hearing device.

4. Hearing device according to claim 1, wherein the thread is configured to facilitate removal of the threadless tube from the angle piece without damaging the hearing device by allowing the threadless tube to be screwed off from the angle piece.

5. Hearing device according to claim 1, wherein the thread is sharp-edged.

6. Hearing device according to claim 1, wherein the thread includes an inclined angle; wherein the inclined angle facilitates removal of the threadless tube from the angle piece without damaging the hearing device by allowing the threadless tube to be removed from the angle piece.

7. Process for the connection of an acoustic threadless transmission tube at an exit of a hearing device to an angle piece or ear-hook of the hearing device characterized in that the end of the acoustic threadless transmission tube is attached to the threadless tube by either a force-fit slipping of the threadless tube over an edge of a thread arranged at an end of the angle piece or the tube is screwed onto the thread.

8. Process according to claim 7, farther comprising the step of removing the threadless tube from the angle piece, wherein the thread on the angle piece is configured to facilitate removal of the threadless tube without damaging the hearing device by allowing the threadless tube to be screwed off from the angle piece.

9. Process according to claim 7, wherein the thread is sharp-edged.

10. Process according to claim 7, farther comprising the step of removing the threadless tube from the angle piece, wherein the thread on the angle piece includes an inclined angle and the thread is configured to facilitate removal of the threadless tube without damaging the hearing device by allowing the threadless tube to be removed from the angle piece.

11. A hearing-device for being worn at the pinna or behind the ear comprising:

an exit for transmitting sound-signals wherein the exit is located at an end of the hearing-device;

a threadless tube-like connecting-element or an angle piece screwed onto a thread of the hearing device at the exit;

wherein the threadless tube-like connecting-element or the angle piece is arranged for connecting the exit with a tube for the sound transmission to an ear-canal; and wherein the connecting-element or the angle piece has a thread at one end wherein the thread has an edge and the thread is configured for an attachment of the threadless tube over the edge of the thread to the connecting-element or the angle piece by either a force-fit slipping of the threadless tube over the edge of the thread or by a screwing the threadless tube over the thread.

12. Hearing-device according to claim 11, wherein between the thread and a wall of the connecting element or the angle piece respectively a sealing-surface is arranged.

13. Hearing device according to claim 11, wherein the thread is configured to facilitate removal of the threadless tube from the angle piece without damaging the hearing device by allowing the threadless tube to be screwed off from the angle piece.

14. Hearing device according to claim 11, wherein the thread is sharp-edged.

15. Hearing device according to claim 11, wherein the thread includes an inclined angle; wherein the inclined angle facilitates removal of the threadless tube from the angle piece without damaging the hearing device by allowing the threadless tube to be removed from the angle piece.

* * * * *

UNITED STATES PATENT AND TRADEMARK OFFICE

CERTIFICATE OF CORRECTION

PATENT NO. : 7,590,256 B2
APPLICATION NO. : 10/953678
DATED : September 15, 2009
INVENTOR(S) : Erich Dittli It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1112 days.

Signed and Sealed this

Twenty-first Day of September, 2010

David J. Kappos

David J. Kappos
*Director of the United States Patent and Trademark Office*